United States Patent [19]

DeLavallade

[11] Patent Number: 4,984,854

[45] Date of Patent: Jan. 15, 1991

[54] JEWELRY BOX

[76] Inventor: Annette DeLavallade, 35 Leaf Rd., Delmar, N.Y. 12054

[21] Appl. No.: 395,534

[22] Filed: Aug. 18, 1989

[51] Int. Cl.[5] ..... A47B 88/00

[52] U.S. Cl. ..... 312/330.1; 211/122; 211/1.3

[58] Field of Search ..... 312/330 R, 311, 266, 312/268, 269, 270, 322, 134; 211/122, 1.3, 121; 248/222.4

[56] References Cited

U.S. PATENT DOCUMENTS

| | | | |
|---|---|---|---|
| D. 214,408 | 6/1969 | Pintea . | |
| 746,659 | 12/1903 | Barnes . | |
| 928,980 | 7/1909 | Kaufman et al. | 211/122 |
| 1,736,235 | 11/1929 | Von Kersburg | 312/322 X |
| 2,383,068 | 8/1945 | MacLean | 248/222.4 X |
| 2,553,133 | 5/1951 | Conner . | |
| 2,608,305 | 8/1952 | Sager | 312/311 X |
| 2,708,999 | 5/1955 | Rush . | |
| 3,131,801 | 5/1964 | Marchetti . | |
| 3,190,712 | 6/1965 | Fielden | 312/311 |
| 4,058,356 | 11/1977 | Michal . | |
| 4,467,913 | 8/1984 | Salloum . | |
| 4,771,206 | 9/1988 | Taylor | 312/311 X |

*Primary Examiner*—Joseph Falk

*Attorney, Agent, or Firm*—Schmeiser, Morelle & Watts

[57] ABSTRACT

A jewelry box is provided which is designed to store jewelry in an easily accessible manner. Horizontally oriented drawers are used for flat storage of smaller items and vertically oriented drawers are provided for hanging of longer pieces. The vertically oriented drawers include a belt and pulley system for movably mounting the hooks on which jewelry is hung. The vertically oriented drawers when fully withdrawn may be rotated to allow full viewing of each side.

18 Claims, 3 Drawing Sheets

FIG. 6
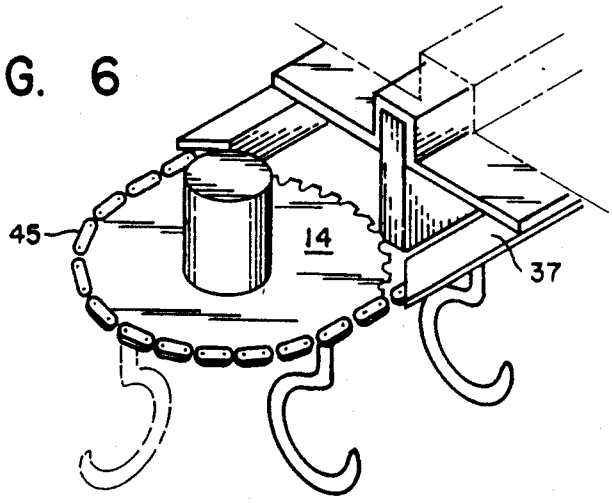
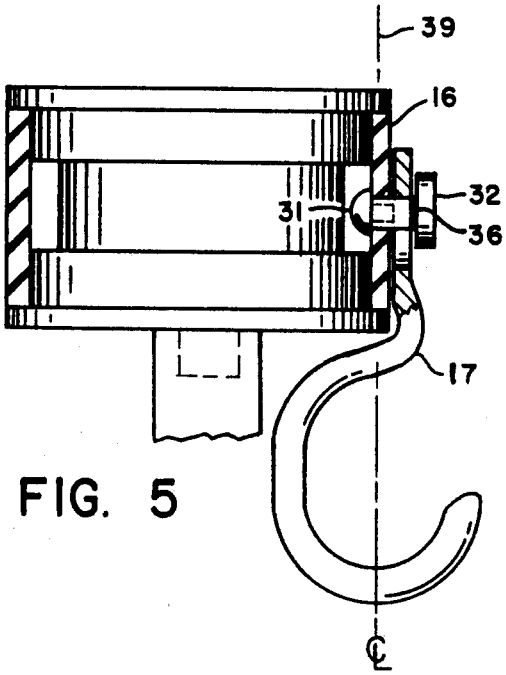
FIG. 5
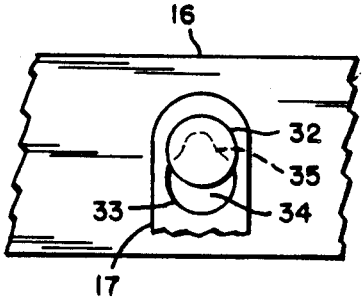
FIG. 4

JEWELRY BOX

BACKGROUND OF THE INVENTION

This invention relates to jewelry storage devices and, more particularly, to jewelry boxes with sliding drawers.

Women in our society often possess a large quantity of jewelry such as rings, bracelets, earrings, necklaces, etc.. These items are usually kept in a dresser drawer or in a jewelry box that has one or two trays suspended above a bottom storage area.

When a piece of jewelry is required, a woman often has to sift through other jewelry to find the sought after piece. Or, in the case of a necklace, the necklace becomes intertwined with other pieces of jewelry and a time consuming separating process becomes necessary.

Relevant prior art to this type of jewelry box is shown in Pat. No. 4,058,356 to Michal and Pat. Des. No. 214,408 to Pintea.

Michal shows a jewelry box in which small pieces of jewelry such as rings, watches and bracelets may be hung from hooks. Longer pieces such as necklaces or chains may be hung from nail-like fingers that extend from a central rotatable tube. This box also acts as a coin bank with the central tube connecting a top slot to a storage area in the base. A pair of doors can be swung to a closed position to conceal the interior of the box. This prior art device lacks horizontal drawers for flat storage of jewelry. In this device, the hanging jewelry is located within the box at all times, thereby limiting the visibility of these pieces.

The Pintea jewelry box contains a plurality of horizontal drawers and an additional center storage area with swinging doors that includes movable jewelry trays. ? n this device, jewelry located on the back portion of the lead tray and on the following trays would be hard to see, since the doors and lead tray restrict the user's visibility.

SUMMARY OF THE INVENTION

The instant invention provides a unique storage unit for jewelry in which the different pieces of jewelry can be easily viewed. The invention also utilizes a unique storage system that eliminates tangling of the pieces of jewelry. It comprises a main box which contains a series of horizontal drawers in the center and a number of vertically oriented drawers on each side of the horizontal drawers.

The horizontal drawers provide flat storage for rings, barrettes, earrings, etc..

The vertically oriented drawers provide storage for long pieces of jewelry such as chains, necklaces or the like. This is accomplished by hanging these pieces from removable hooks. These drawers include a pulley and band system which allows rotation of the jewelry from the rear to the front of the drawer and from one side of the drawer to the other. The drawers, when fully withdrawn from the box, can be pivoted about a vertical axis to allow full and easy viewing of each side of the drawer.

The box also includes swinging doors which, when closed, conceal the vertically oriented drawers.

BRIEF DESCRIPTION OF THE DRAWINGS

In the drawings accompanying and forming part of this application, and wherein like reference characters indicate like parts:

FIG. 4 is an elevation view showing the hook mounted on the band.

FIG. 5 is a cross-sectional view of the band.

FIG. 6 is a perspective view of a vertically oriented drawer showing a guide for a chain.

DESCRIPTION OF THE PREFERRED EMBODIMENT

Figure 1:
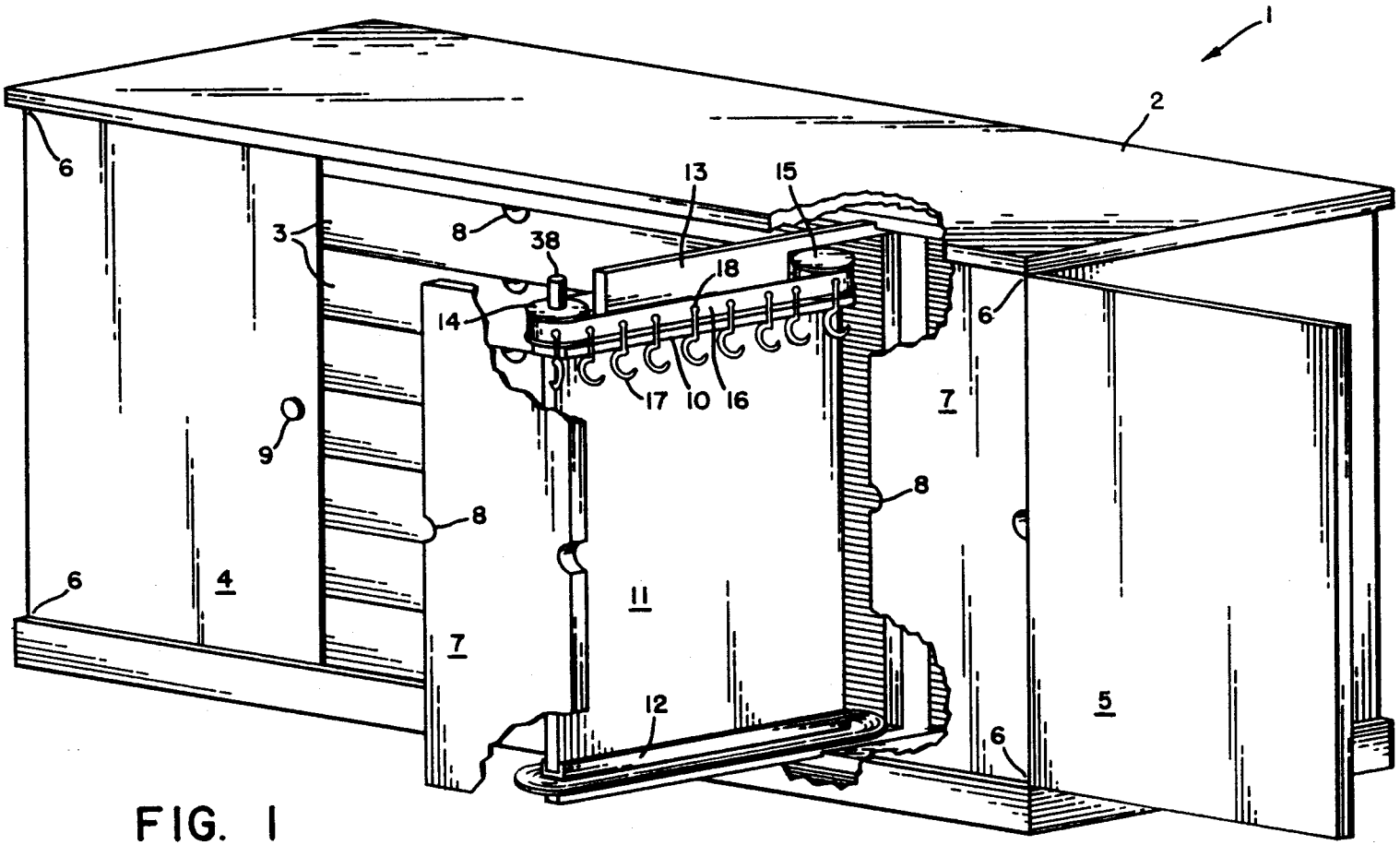
FIG. 1 is a perspective view of the jewelry box showing one of the swinging doors open and one of the vertically oriented drawers partially withdrawn.

In FIG. 1, 1 indicates generally a jewelry box of the instant invention. The box is made up of an outer box structure 2, which slidably receives a plurality of horizontally oriented drawers 3. Swinging doors 4 and 5 are pivotally attached at 6 to the box and rotatably cover a plurality of vertically oriented sliding drawers 7. The drawers have notches 8, which facilitate a user's grasping of the drawer. The swinging doors each have a knob 9 which acts as a handle.

FIG. 1 also shows one of the vertically oriented drawers partially withdrawn. The drawer includes a top portion 10, middle portion 11 and bottom portion 12. The middle portion extends most of the drawer length, leaving a space to allow jewelry to travel from one side to the other, as will be subsequently described. As seen in the figure, the top portion includes a vertically disposed guide tab 13 which fits into a groove in the underside surface of the top of the box. The tab fitting within the groove maintains the drawer in a vertical orientation and, when the drawer is being withdrawn from the box, aligns and guides the drawer as it moves.

The figure also shows the band and pulley system for supporting long pieces of jewelry. A pair of pulleys 14 and 15 are rotatably mounted on the inner and outer ends of the drawer top and receive on their perimeter a band 16. Hooks 17 are removably attached to the band at mounts 18. For clarity, FIG. 1 only shows hooks on one side of the band. Preferentially, hooks would be evenly spaced on the entire band exterior. A chain may be used in place of the band.

The band may be moved by rotating one of the pulleys by hand. FIG. 1 shows a method for accomplishing this by the use of a knob 38 mounted to the forward pulley. The band may also be moved by other well known methods such as by an electrical motor (not shown) or by a wind-up mechanism (not shown).

The band is continuous and continued rotation of either pulley would cause a piece of jewelry hanging from one of the hooks to travel along both sides of the drawer and then back to its starting position.

Figure 2:
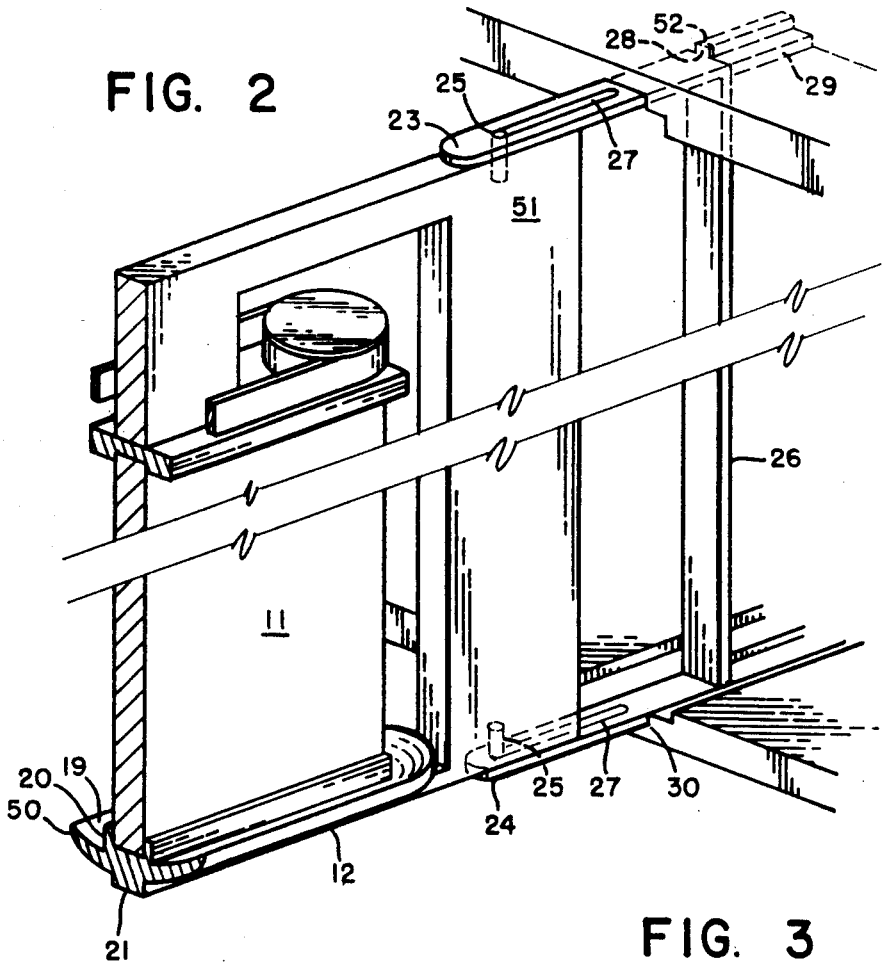
FIG. 2 is a detailed elevation view of a rear portion of one of the vertically oriented drawers.

The bottom portion of the drawer can be seen in FIGS. 1 and 2. The bottom portion comprises a catch tray 50 covered with a soft material 19. The top central portion of the catch tray connects to the drawer middle portion by a raised receiving portion 20. The bottom of the catch tray includes lower guide means 21 which fits into a complementary groove in the bottom of the box. The catch tray is used to catch any jewelry which falls from the hooks and also to support the lower portion of any jewelry which extends down to the tray.

Figure 3:
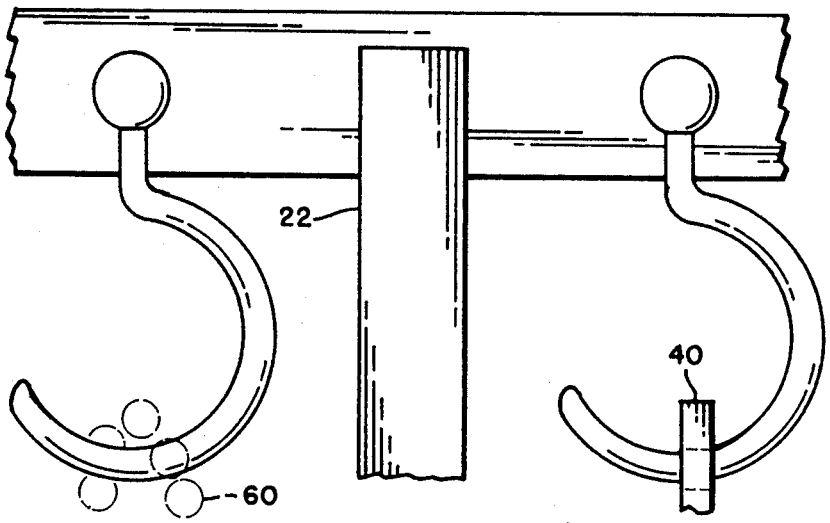
FIG. 3 is an elevation view showing a fixed divider mounted on the band, a divider hanging from a hook and the top of a necklace hanging from a hook.

FIG. 3 shows the band of the band and pulley system with optional dividers and the top portion of a necklace 60 hanging from a hook. The dividers comprise a rectangular sheet of plastic which is long enough to reach from the band to proximate the top of the catch tray. The divider 22 is fixedly mounted to the band by conventional means. A similar divider 40 is shown hanging from one of the hooks. A similar divider (not shown) can also be attached in place of one of the hooks. The dividers separate the jewelry and provide a convenient means to separate the jewelry by color or by type.

FIG. 2 also shows a rear portion of the guide used on the vertically oriented drawers. The drawer has a rear connector portion 51 that extends from the top of the drawer to the drawer bottom. The connector has top 23 and bottom 24. Vertically extending from the top and bottom are pivot pins 25. A U-shaped retaining member 26 is attached to the rear of the drawer by upper and lower channels 27 which receive the pivot pins 25. The top portion of the retaining member includes a tab 52 which contacts a stop 28 to prevent the drawer from becoming disengaged from the box. Upper and lower slots 29 and 30 are shown in the box inner surfaces for receiving the drawer guide tabs and the U-shaped retaining member.

In the instant invention, since a flexible band or chain is used, the mounting method shown in FIG. 5 is particularly advantageous. A rivet 31 passes through the band 16 and lockably engages a lug 32. As can be seen in FIG. 4, the top portion of each hook has an upside down key hole shaped channel 33. The large portion 34 of the hook channel is placed over the lug and then the hook is slid downwards and the small portion 35 of the hook channel securely engage the lug. The hook is prevented from falling off the lug by a lug flange portion 36. An alternative embodiment would have the channel in the band and the lug on the hook.

FIG. 5 also shows the centerline of a hook that is mounted on the band. The hook is designed and mounted so that the hook's vertical centerline 39 is in line with the belt. This minimizes twisting of the belt when the hook is loaded.

FIG. 6 shows an alternative embodiment in which a guide track 37 is mounted on the top of the drawer in the same plane as the pulleys 14 and 15. Each side of the guide track is "L" shaped in cross-section and the track is especially useful when the band 16 is replaced by a chain 45.

In use, when a necklace is required, the user would open one or both of the swinging doors to expose the vertically oriented drawers.

Then, the drawer could be partially withdrawn. If the needed jewelry was not in view, the knob would be rotated and the entire band of jewelry would rotate and any piece of hanging jewelry would soon be brought into view.

Alternatively, the drawer could be withdrawn from the box until the U-shaped member hits the stop. The entire drawer could then be pivoted from side to side so that the user would have full access to both sides of the drawer. The pivotal movement is enabled by the pivot pins 25 rotating within channels 27.

Another advantage of the instant invention results from the pivoting action of the drawers in combination with the belt and pulley system. When choosing a piece of jewelry, a woman will often place similar pieces of jewelry together by type, color or type of material so that she can compare them and then pick out the best piece for her outfit. The invention allows the jewelry to be hung in any manner seen fit by the user. Therefore, for example, a woman can hang all of her jewelry one adjacent the other in an order based on the jewelry color. When it was time for the woman to pick out a piece of jewelry, she could withdraw a particular vertically oriented drawer and pivot it to one side. At this point, she can easily view all the jewelry hung on one side of the drawer. She can then rotate knob 38 until all the jewelry of a particular range of colors was displayed on one side. She could then easily choose piece of jewelry of the right color to best match her outfit.

The embodiment and procedures disclosed herein have been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention.

I claim:

1. A jewelry box comprising:

an outer box structure;

at least one horizontally oriented drawer slidably received in said box structure, said horizontally oriented drawer providing a flat storage area for jewelry;

at least one vertically oriented drawer also slidably received in said box structure, said vertically oriented drawer providing a storage area where jewelry can be hung, said at least one vertically oriented drawer comprising a top portion, middle portion, and bottom portion, said top portion comprising a guide means which engages a receiving means operatively connected to an inner surface of said box structure, said guide means functioning to guide the drawer when it slides in or out of said box structure, said top portion of said vertically oriented drawer also comprising a band and pulley system for moving jewelry around a perimeter of said top portion, said band and pulley system comprising a horizontally oriented band means movably supported by at least two pulleys that are rotatably mounted on support means located on said drawer top portion, and a plurality of hook means mounted on said band means for hanging jewelry therefrom.

2. The device of claim 1 wherein said bottom portion of said at least one vertically oriented drawer includes a catch tray located about its periphery, said catch tray extending below said hook means whereby if jewelry should fall off one of said hook means, it would be caught by said catch tray.

3. The device of claim 2 in which the catch tray is lined with a soft material.

4. The device of claim 1 wherein at least one of said hook means has a bottom loop upon which at least a portion of a piece of jewelry can rest and at least a portion of said bottom loop is located beneath said band means.

5. The device of claim 1 wherein at least one elongated vertical divider means is hung from at least one of said hook means.

6. The device of claim 1 wherein said guide means includes a pivot portion that allows the drawer to be pivoted about a vertical axis once the drawer is withdrawn from the box structure a predetermined distance.

7. The device of claim 1 in which the band and pulley system includes means operatively attached to one of said pulleys to enable rotation of the band means by a user's hand.

8. The device of claim 7 wherein said rotation enabling means comprises a hand graspable portion mounted on the top of at least one pulley.

9. The device of claim 1 in which the at least one horizontally oriented drawer is located in the center of the box structure and there is at least one vertically oriented drawer positioned on each side of the at least one horizontally oriented drawer.

10. The device of claim 9 also comprising a pair of doors mounted to the front of the box structure which can swing about a vertical axis and which, when closed, cover the vertically oriented drawers and when open, expose said vertically oriented drawers.

11. The device of claim 1 in which the drawers also comprise front faces and notch means are provided in said faces to facilitate grasping by a user's hand.

12. The device of claim 1 in which the hook means are removably attached to the band means by a prong in one and a keyhole shaped slot in the other.

13. The device of claim 1 wherein a vertical divider means is fixedly attached to the band means and functions to separate jewelry hanging from adjacent hook means.

14. The device of claim 1 wherein at least one vertical divider means is removably attached to the band means in place of one of the hook means.

15. A jewelry box comprising:

an outer box structure, at least one horizontally oriented drawer slidably received in said box structure, said horizontally oriented drawer providing a flat storage area for jewelry, at least one vertically oriented drawer also slidably received in said box structure, said vertically oriented drawer providing a storage area where jewelry can be hung, said at least one vertically oriented drawer comprising a top portion, middle portion, and bottom portion, said top portion comprising a guide means which engages a receiving means operatively connected to an inner surface of said box structure, said guide means functioning to guide the drawer when it slides in or out of said box structure, said top portion of said vertically oriented drawer also comprising a band and pulley system for moving jewelry around a perimeter of said top portion, said band and pulley system comprising a horizontally oriented band movably supported by at least two pulleys that are rotatably mounted on support means located on said top portion and, a plurality of hook means mounted on said band, for hanging jewelry therefrom and, said guide means of said at least one vertically oriented drawer comprising a forward portion and a rearward portion, said rearward portion including a pivot means that allows said drawer to pivot about a vertical axis when said drawer is withdrawn from the box structure a predetermined distance.

16. The box of claim 15 also comprising at least one vertical divider operatively mounted on said band, said divider serving to separate at least one of said plurality of hook means from another of said hook means.

17. The box of claim 15 wherein said box structure slidably receives a plurality of vertically oriented drawers and a plurality of horizontally oriented drawers.

18. The box of claim 15 wherein said hooks are removably mounted on said band.

* * * * *